US005521572A

United States Patent [19]

Goodwin et al.

[11] Patent Number: 5,521,572

[45] Date of Patent: May 28, 1996

[54] UNSHIELDED AIR-COUPLED CURRENT TRANSFORMER

[75] Inventors: R. Wendell Goodwin, Dunwoody; Charles W. Roberts, Roswell, both of Ga.

[73] Assignee: Schlumberger Industries, Inc., Norcross, Ga.

[21] Appl. No.: 337,910

[22] Filed: Nov. 14, 1994

Related U.S. Application Data

[63] Continuation of Ser. No. 4,403, Jan. 14, 1993, abandoned.

[51] Int. Cl.[6] ..... H01F 27/24; H01F 27/30

[52] U.S. Cl. ..... 336/178; 336/175; 336/184; 336/212

[58] Field of Search ..... 336/178, 175, 336/174, 176, 184, 212, 234

[56] References Cited

U.S. PATENT DOCUMENTS

| | | | |
|---|---|---|---|
| 1,415,505 | 5/1922 | Angus | 336/175 |
| 2,148,641 | 2/1939 | Reich | 336/175 |
| 3,195,082 | 7/1965 | Wetherill et al. | 336/212 |
| 3,268,843 | 8/1966 | Popp | 336/175 |
| 3,525,964 | 8/1970 | Stevenson | 336/175 |
| 3,546,565 | 12/1970 | Downing et al. | 336/175 |
| 4,800,356 | 1/1989 | Ellis | 336/234 |

OTHER PUBLICATIONS

"Current Transformers", H. E. Forrest, Electrical Review, Jul. 9, 1948, pp. 51–54.

*Primary Examiner*—Thomas J. Kozma
*Attorney, Agent, or Firm*—Keith G. W. Smith

[57] ABSTRACT

An air-coupled current transformer is provided with a primary current conductor and two secondary coils connected such that the emf induced in each coil by an external disturbing magnetic flux is subtractive, whereas the emf induced by the current in the primary is additive. Two ferromagnetic core pieces enhance the rejection of the emf induced by the disturbing flux. Ceramic spacers are inserted into air gaps between the core pieces for maintaining the gaps fixed to keep the scale factor of the transformer independent of temperature.

15 Claims, 6 Drawing Sheets

UNSHIELDED AIR-COUPLED CURRENT TRANSFORMER

This application is a continuation of application Ser. No. 08/004,403, filed on Jan. 14, 1993, now abandoned, entitled UNSHIELDED AIR-COUPLED CURRENT TRANSFORMER.

TECHNICAL FIELD

This invention relates generally to current transformers, and more particularly, to unshielded air-coupled current transformers of novel construction.

BACKGROUND ART

Air-coupled current transformers used in electric current measuring instruments are well known. They comprise a primary winding connected in series with a line carrying the current to be measured. The output voltage, which is matched to the instrument, is measured across a secondary winding coupled through large air gaps to the primary winding. While the output of a conventional current transformer is a voltage across a series resistor in the secondary circuit, which is in phase with the line current, the output of an air-coupled current transformer is a voltage proportional to the time derivative of the line current. Unlike conventional current transformers, air-coupled current transformers are immune to saturation effects caused by the presence of a D.C. current component on the mains.

Reference is now made to FIG. 1, wherein an air-coupled current transformer comprises a single-turn primary winding 21 with a concentric secondary coil 23. The winding and coil are contained in a five-sided magnetic box 25, which serves both as a shield and as a path for flux generated by the primary current.

Subsequent reconfigurations to accommodate dual primary windings have been made. In the design shown in FIG. 2, an air-coupled current transformer comprises two primary windings 31 and a secondary coil 33 covered by a four-sided magnetic box 35.

Immunity to external electromagnetic disturbance is achieved in the same manner in both designs. The magnetic box 25 or 35, which conducts disturbing flux around the secondary coil, provides a magnetic shield protecting against the external electromagnetic disturbance.

Thus, to provide immunity to external electromagnetic disturbance the prior art air-coupled transformers require a magnetic shield, made of a suitable nickel-iron alloy such as μ-metal, and require metal-forming operations such as deep-drawing or bending followed by an annealing operation, i.e., such as by annealing in dry hydrogen.

Therefore, it would be desirable to provide an air-coupled current transformer, wherein high immunity to external electromagnetic disturbance can be achieved without a magnetic shield.

Furthermore, the scale factor relating input current to output voltage depends on the size of the gap between the primary winding and the secondary coil. Due to the thermal expansion of the primary winding and the secondary coil, temperature change results in changing the size of the gap. It makes the scale factor dependent on temperature.

Thus, it also would be desirable to provide an air-coupled current transformer having scale factor independent of temperature.

DISCLOSURE OF THE INVENTION

Accordingly, one advantage of the invention is in achieving high immunity of an air-coupled current transformer to external electromagnetic disturbance without a magnetic shield.

Another advantage of the invention is in maintaining the scale factor of an air-coupled current transformer independent of temperature.

A further advantage of the invention is in reducing the cost of an air-coupled current transformer.

The above and another advantages of the invention are achieved, at least in part, by providing an air-coupled transformer comprising primary circuit means responsive to an input line for supplying an input current, and first and second secondary circuit means adjacent the primary circuit means. The first secondary circuit means induces a first electromotive force (emf) in response to the input current and a second emf in response to a disturbing magnetic flux from an external source. The second secondary circuit means induces a third emf in response to the input current and a fourth emf in response to a disturbing magnetic flux from an external source. The first and second circuit means are coupled so as to form the output signal of the transformer corresponding to the sum of the first and the third emf and to the difference between the second and the fourth emf. Magnetic coupling means is provided for maintaining a coupling magnetic flux between the primary circuit means and the first and second secondary circuit means to reduce the difference between the second and the fourth emf. The magnetic coupling means has at least a pair of air gaps.

In accordance with one aspect of the invention, the magnetic coupling means comprises at least a pair of ferromagnetic pieces. The first and second secondary circuit means are interposed between the pair of ferromagnetic pieces.

In accordance with another aspect, one or more spacers made of material with a low coefficient of thermal expansion are inserted into the air gaps, or spacers can be formed as one unit, to maintain the scale factor of the transformer constant over temperature. Each of the first and second secondary circuit means comprises a coil, and each of the spacers comprises a spacer made of a material having a suitably low thermal coefficient of expansion, i.e., a ceramic spacer, inserted into the coil. Each of the ferromagnetic pieces comprises a plate having a flat inside surface and which is rigidly fastened to the ceramic spacers to maintain the air gaps fixed.

In accordance with a further aspect of the invention, the primary circuit means comprises a current conductor interposed between the ferromagnetic pieces and the coils so as to pass through a window formed by the ferromagnetic pieces and the secondary coils and to be movable with respect to the ferromagnetic pieces and the coils.

Still other advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 3:
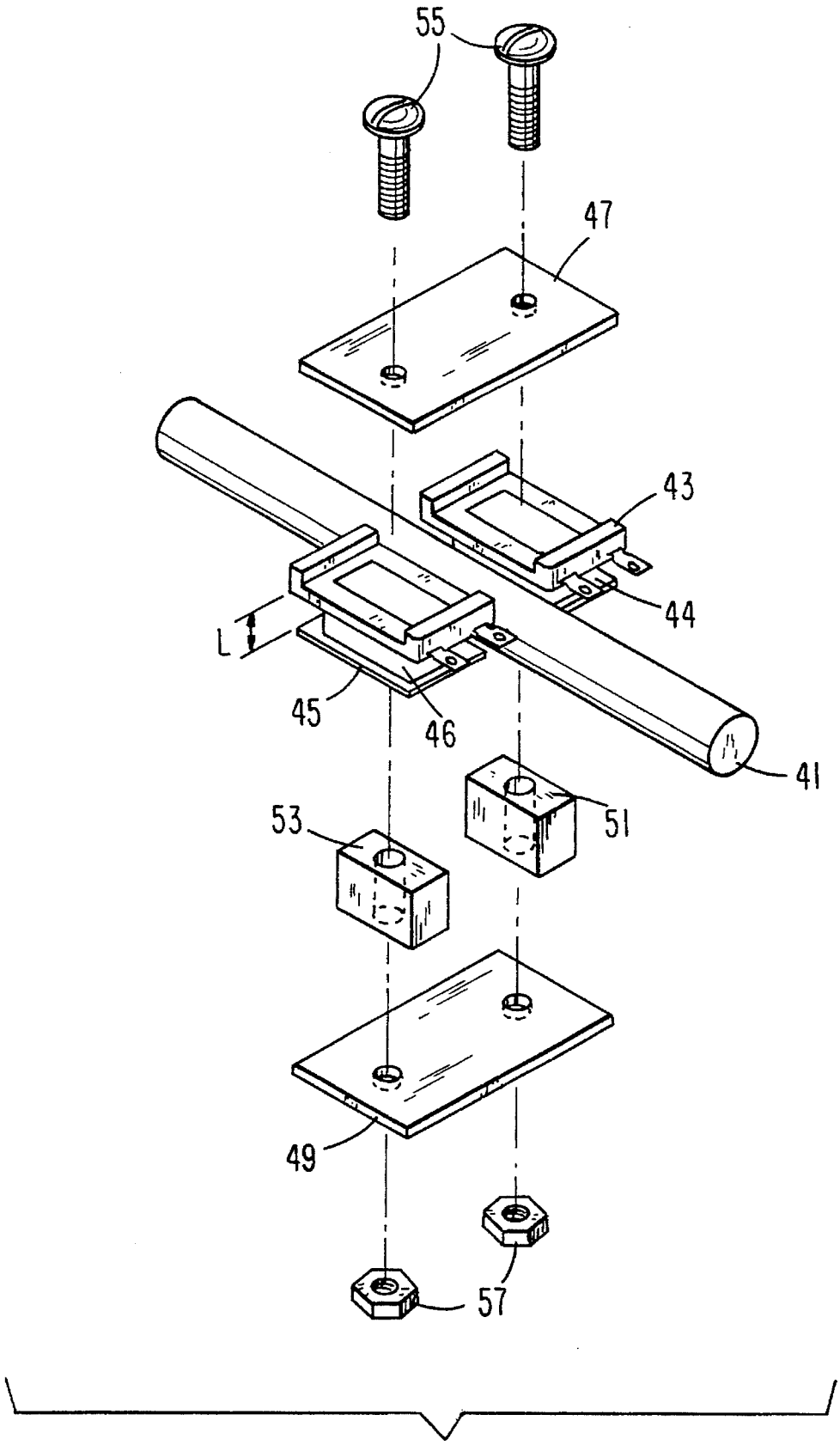
FIG. 3 is an exploded view showing components of an air-coupled current transformer according to the preferred embodiment of the invention.

Reference is now made to FIG. 3 of the drawings showing components of an air-coupled current transformer according to the preferred embodiment of the present invention, which comprises a current conductor 41 as a primary and a pair of rectangular secondary coils 43 and 45 surrounding the conductor 41. The coils 43 and 45 are symmetric about the conductor 41. An input current being measured flows through the conductor 41. The input current induces in the secondary coils corresponding electromotive forces (emf), which cause an output voltage of the transformer to be formed at the terminals of the coils.

Figure 7A:
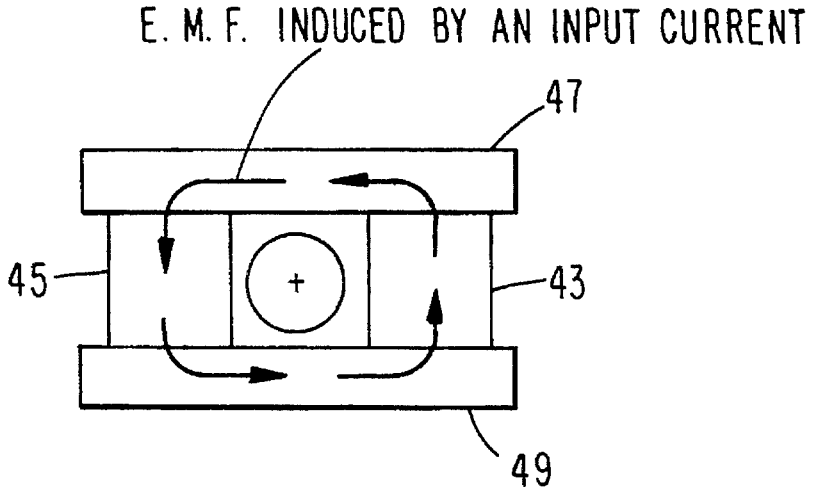
FIG. 7(*a*) and 7(*b*) show secondary coils arranged to respond additively to flux induced by input current and subtractively to disturbing flux from an external source.
Figure 7B:
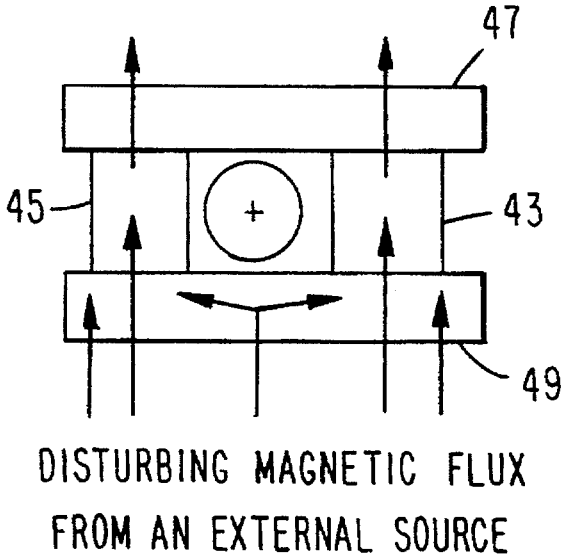

In the absence of a magnetic shield, a disturbing magnetic flux from an external source (not shown) freely passes through the secondary coils. To provide protection against the external disturbing flux, the winding sense of the two secondary coils is such that the emf induced in each coil by the disturbing flux is subtractive, whereas the emf induced by the input current is additive, as shown symbolically in FIGS. 7(*a*) and 7(*b*).

Figure 4:
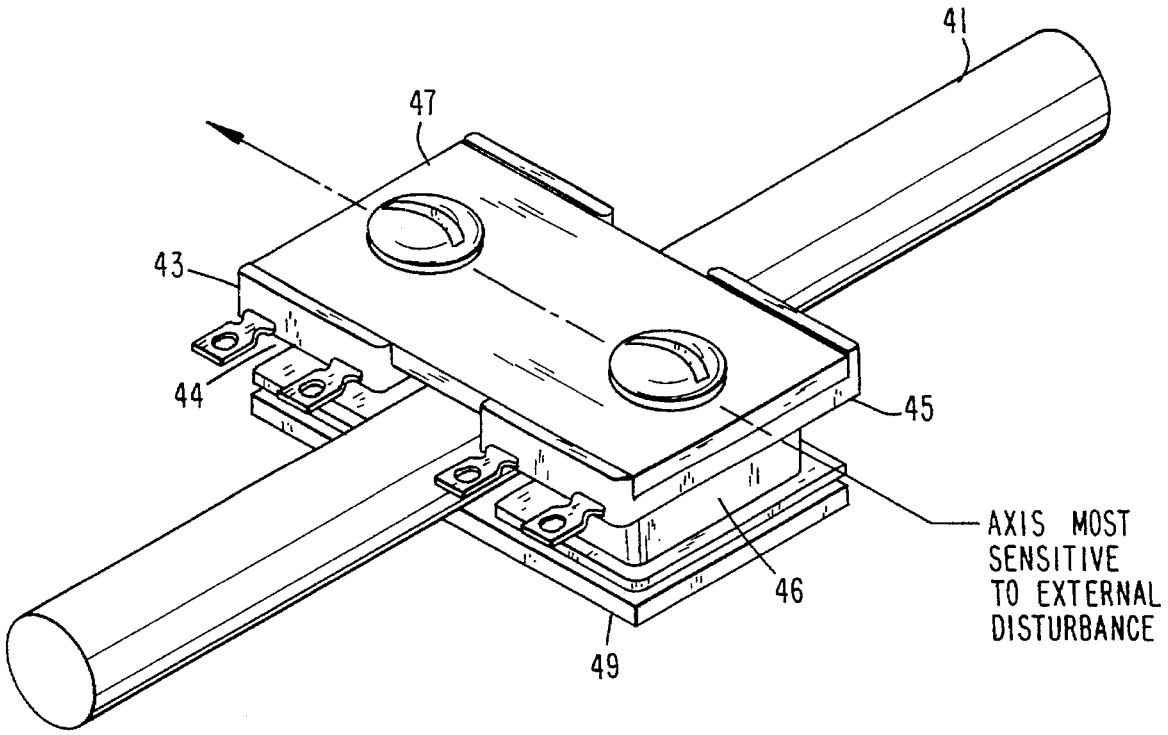
FIG. 4 is a diagram showing the air-coupled current transformer as an assembly according to the preferred embodiment of the invention.

If the flux density due to the external source is spatially uniform, the emf induced by the disturbing flux will be common to both the coils and be rejected. However, if the flux density is not spatially uniform, flux gradients will exist along the axes of the transformer. Because the coils are symmetrical about the conductor, the transformer is sensitive to the flux gradient along only one of its three axes. The direction of the sensitive axis is indicated in FIG. 4, wherein the air-current transformer as an assembly is shown.

The flux gradient along the sensitive axis causes an error signal to be formed at the terminals of the secondary coils. The error signal is proportional to the difference in the mean flux density through each coil.

In accordance with the preferred embodiment of the present invention, to reduce the flux gradient seen by the secondary coils, magnetic core pieces 47 and 49 (FIG. 3) are provided so as to cover the secondary coils from both sides. Since these core pieces are excellent magnetic conductors they tend to homogenize or reduce the slope of the flux gradient in the space between them. The preferred embodiment of the invention uses 0.062" thick rectangular ferromagnetic plates as the core pieces 47 and 49. These plates reduce the sensitivity to the flux gradient by a factor of 10. That is, without the core pieces, the output voltage caused by a flux gradient along the sensitive axis would be 10 times higher.

Also, the presence of the core pieces confers immunity to the detrimental effects of ferromagnetic material in the vicinity of the transformer. In a totally air-coupled current transformer, in which the flux, which couples primary to secondary, flows entirely through the air, there exists a sensitivity to the presence of ferromagnetic material nearby. Since the coupling flux is not spatially confined, as it would be in an iron-core transformer, nearby magnetic material can alter the characteristics of the flux coupling path. Therefore, the coefficient of coupling can be altered, and with it, the transformer scale factor. With the introduction of the two rectangular magnetic core elements 47, 49, which become part of the magnetic coupling circuit, the flux is confined to a small region. Magnetic material in the vicinity has no effect on the coefficient of coupling.

For fabrication of the magnetic core pieces, a ferromagnetic material, preferably comprising an alloy having 80% nickel, is used. The remaining 20% of the nickel alloy in the preferred embodiment comprises approximately 17% iron and 3% molybdenum, although some variation in the 20% portion of the alloy is tolerable. However, since the core pieces are much smaller than the shield, far less material is needed. Furthermore, unlike the shield, fabrication of the magnetic core pieces 47, 49 consists of a single stamping operation followed by an optional hydrogen anneal, which optimizes the magnetic properties of the material. Therefore, the cost of the transformer according to the invention is significantly less than the cost of the prior art devices.

According to the preferred embodiment of the invention, the magnetic flux, which passes through the secondary coils, circulates around the magnetic path comprising two magnetic core pieces 47 and 49 and two air gaps 44 and 46 containing the secondary coils 43 and 45. The scale factor of the air-coupled transformer, which relates the input current to the output voltage, depends on the length L (FIG. 3) of each gap 44, 46 in the magnetic path. To maintain the gap length fixed, ceramic spacers are used to set the gaps. As shown in FIG. 3, ceramic spacers 51 and 53 are respectively inserted into the secondary coils 43 and 45. The rectangular magnetic core pieces 47 and 49 are rigidly fastened to the spacers with bolts 55 and nuts 57.

The spacers 51 and 53 are made from aluminum oxide, which has a very low coefficient of thermal expansion (6 μm/m/°C.). As the standard operating ambient temperature range for U.S. meters is −40° C. to +85° C., the scale factor change over this temperature range is less than ±0.04%.

Figure 1:
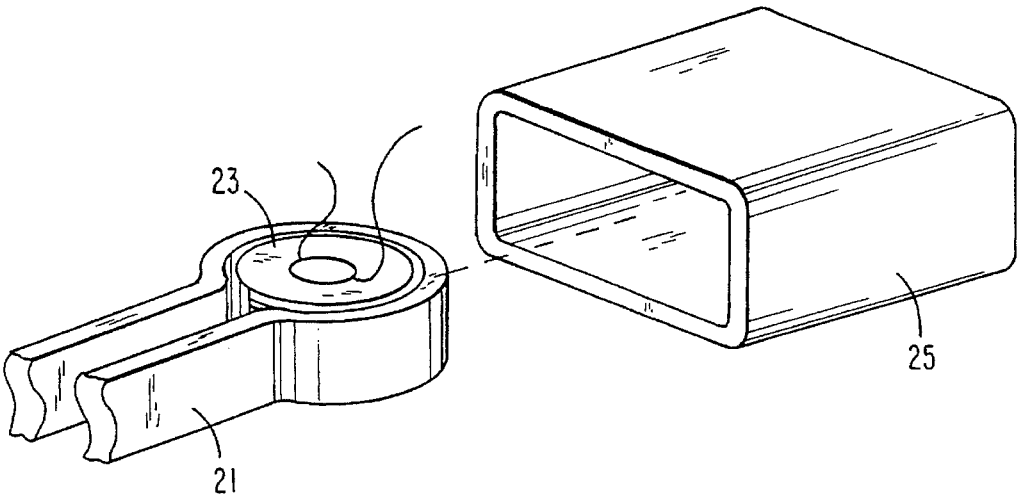
Figure 1 PRIOR ART
FIG. 1 is a diagram showing a prior art air-coupled current transformer with a five-sided shield.
Figure 2:
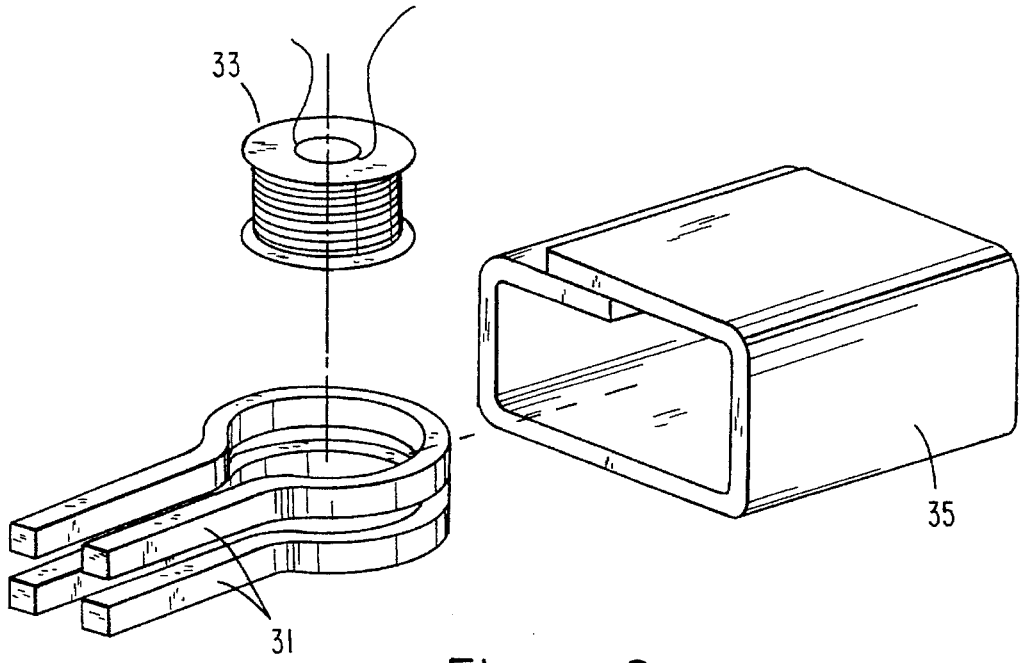
Figure 2 PRIOR ART
FIG. 2 is a diagram showing a prior art air-coupled current transformer having dual primaries and a four-ended shield.

Furthermore, heating effects due to ohmic losses in the current conductor usually made of copper are significant. The amount of heat transferred by conduction from the conductor to the rest of the current transformer is proportional to the physical interface area. In the prior art designs (FIGS. 1 and 2), the interface area was that of a whole turn. In the preferred embodiment where the primary passes straight through, the interface area is reduced by a factor of 5. Thus, the heating effects of primary current are mitigated.

Figure 5:
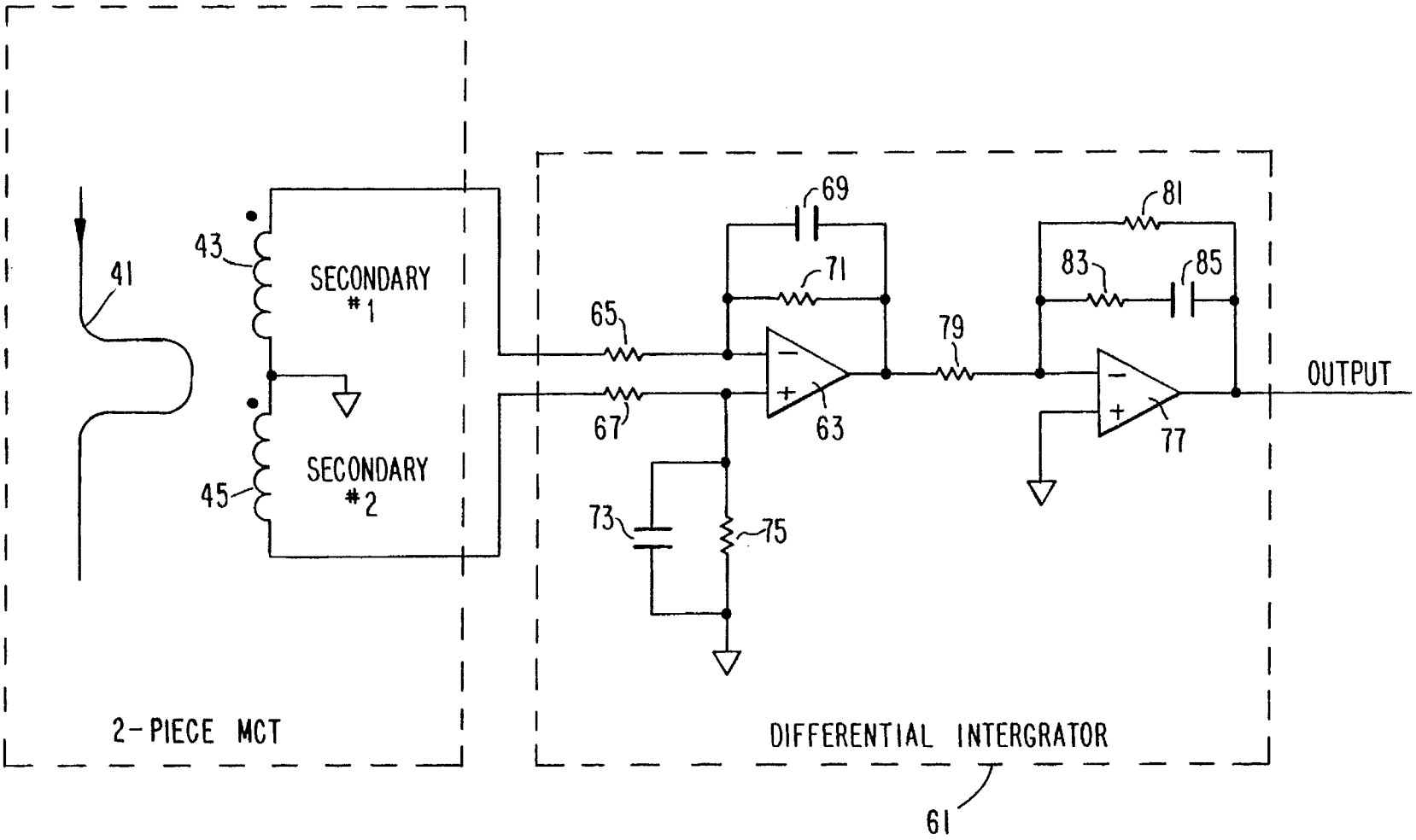
FIG. 5 is a schematic diagram of the air-coupled current transformer with a differential integrator at its output.

Reference is now made to FIG. 5, wherein the schematic diagram of the air-coupled current transformer shows the current conductor 41 connected in series with a line carrying an input current to be measured. The secondary coils 43 and 45 are represented by differentially connected inductors. An advantage of dual secondary coils, used differentially, is their inherent ability to reject electrostatic signals which are capacitively coupled from primary to secondary. These signals are common to both coils and are rejected. This eliminates the need for electrostatic shielding.

The outputs of the secondary coils are voltages in phase quadrature with the input current. To form the voltage in phase with the input current, the outputs of the secondary coils are connected to the inputs of differential integrator 61, which comprises a first operational amplifier 63 having its inputs connected to the secondary coils 43 and 45 through resistors 65 and 67. A parallel RC-circuit comprising a capacitor 69 and a resistor 71 is provided in a negative feedback loop of the amplifier 63. A parallel RC-circuit consisting of a capacitor 73 and resistor 75 is connected between ground and the non-inverting input of the amplifier 63. A second operational amplifier 77 has its inverting input connected to the output of the amplifier 63 through a resistor 79. A negative feedback loop of the amplifier 77 comprises a resistor 81 connected in parallel with a series RC-circuit consisting of a resistor 83 and capacitor 85. The differential integrator 61 performs a 90° phase shift. Its output is the voltage in phase with the current to be measured.

Figure 6:
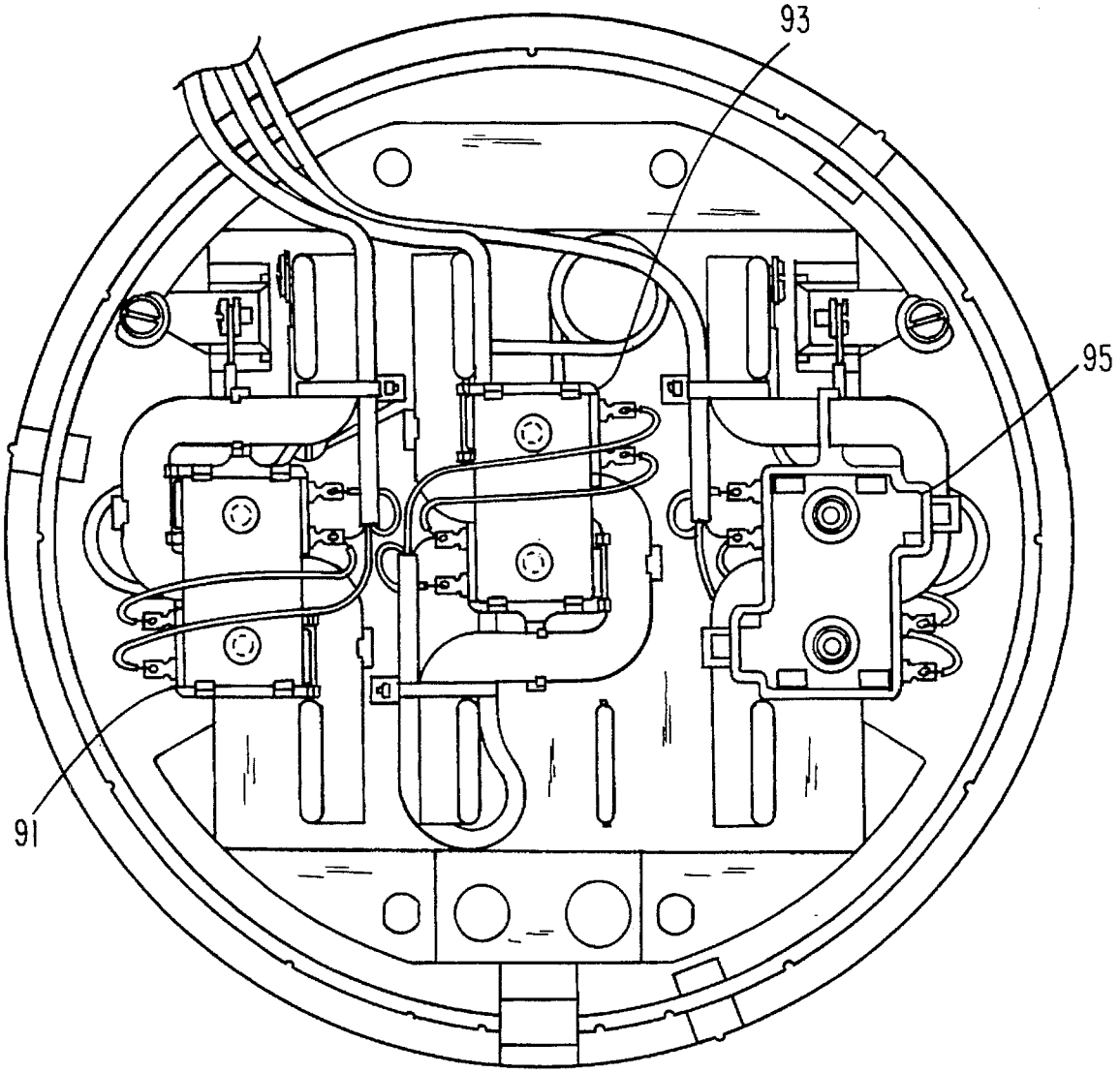
FIG. 6 is a diagram showing a layout of the air-coupled transformer in a polyphase meter base.

Reference is now made to FIG. 6, wherein a polyphase meter base layout of the air-coupled current transformers 91, 93 and 95 used in each of the three phases is shown. In a polyphase meter, external disturbances affecting the air-coupled transformer are primarily due to current flowing in primaries of the transformers in other phases. Other types of external disturbances are generally either too far away to be a problem, or are not synchronous with the line voltage and therefore result in no metering error. The non-uniformity of the flux density due to other phase currents is known and is controllable by orienting primary windings. Since the air-coupled transformer according to the invention is only sensitive to a flux density gradient along one axis, it can be oriented so that flux density gradients due to currents in other phases are along insensitive axes. An example of such an orientation is shown in FIG. 6, wherein each of the air-coupled transformers 91, 93 and 95 is oriented so as to have a current flow in the primaries of the adjacent transformers directed along insensitive axis.

There accordingly has been described an unshielded air-coupled current transformer, which incorporates a magnetic circuit with large air gaps to magnetically couple a primary with two secondary coils. The winding sense of the two secondary coils is such that the emf induced in each coil by an external disturbing magnetic flux is subtractive, whereas the emf induced by the current in the primary is additive. The magnetic circuit, which includes two ferromagnetic core pieces, enhances the rejection of the emf induced by the disturbing flux. Hence high immunity of an air-coupled current transformer to external electromagnetic disturbance can be achieved without a magnetic shield.

As the scale factor of an air-coupled current transformer depends on the length of the air gaps in the magnetic circuit, which changes with temperature, two ceramic spacers inserted into the gaps are used to maintain the gap length fixed. Accordingly, the scale factor of an air-coupled current is maintained independent of temperature.

In this disclosure, there is shown and described only the preferred embodiment of the invention, but it is to be understood that the invention is capable of changes and modifications within the scope of the inventive concept as expressed herein. For example, although spacers 51 and 53 are described as being formed of ceramic, other materials having low thermal coefficient of expansion or a combination of materials having a net low thermal coefficient of expansion are applicable.

We claim:

1. An unshielded air-coupled current transformer for transforming an input current flowing in an input line into an output signal comprising:

(a) a primary circuit means responsive to an input current on an input line;

(b) a first secondary circuit means adjacent said primary circuit means for inducing a first electromotive force (emf) in response to the input current and for inducing a second emf in response to an external disturbing magnetic flux;

(c) a second secondary circuit means adjacent said primary circuit means for inducing a third emf in response to the input current and for inducing a fourth emf in response to the external disturbing magnetic flux;

(d) said first and said second secondary circuit means being coupled so as to form the output signal corresponding to the sum of the first and the third emf and to the difference between the second and the fourth emf;

(e) magnetic coupling means for providing a coupling magnetic flux between said primary circuit means and said first and said second secondary circuit means to minimize the difference between the second and the fourth emf; and (f) said magnetic coupling means comprising a pair of plates, said plates being substantially flat, substantially rectangular, and substantially parallel, said plates being made of magnetic material and having at least a pair of air gaps therebetween, said primary circuit means and said first and said second secondary circuit means being between said pair of plates with said first and said second secondary circuit means surrounding no magnetic core material.

2. The apparatus of claim 1, wherein said magnetic coupling means comprises at least a pair of ferromagnetic pieces with the air gaps between said ferromagnetic pieces.

3. The apparatus of claim 2, wherein said first and second secondary circuit means are interposed between said pair of ferromagnetic pieces.

4. The apparatus of claim 3, wherein at least a pair of spacers made of material with a low coefficient of thermal expansion are within the air gaps.

5. The apparatus of claim 4, wherein each of said first and second secondary circuit means comprises a coil, and each of said spacers comprises a ceramic spacer within said coil.

6. The apparatus of claim 5, wherein each of said ferromagnetic pieces comprises a rectangular plate rigidly fastened to said ceramic spacer.

7. The apparatus of claim 6, wherein said primary circuit means comprises a current conductor interposed between said ferromagnetic pieces and said coils so as to be perpendicular to a window formed by said ferromagnetic pieces and said coils

8. An unshielded air-coupled transformer for transforming an input current flowing in an input line into an output signal comprising:

(a) a primary circuit coupled to said input line for supplying the input current;

(b) a first secondary circuit adjacent said primary circuit;

(c) a second secondary circuit adjacent said primary circuit;

(d) said first and said second secondary circuits being coupled so as to form the output signal in response to the input current and to reduce a disturbing magnetic flux from an external source;

(e) a magnetic circuit magnetically coupling said primary circuit and said first and said second secondary circuits to further reduce the disturbing magnetic flux;

(f) said magnetic circuit comprising a pair of plates, said plates being substantially flat, substantially rectangular, and substantially parallel, said plates being made of magnetic material and having at least a pair of air gaps therebetween, said primary circuit and said first said said second secondary circuit being between said of plates with said first and said second secondary circuit surrounding no magnetic core material.

9. The air-coupled transformer of claim 8, wherein said magnetic circuit comprises at least a pair of ferromagnetic pieces with the air gaps between said ferromagnetic pieces.

10. The air-coupled transformer of claim 9 wherein said first and second secondary circuits are interposed between said pair of ferromagnetic pieces.

11. The air-coupled transformer of claim 10, wherein at least a pair of spacers made of material with a low coefficient of thermal expansion are within said air gaps.

12. The air-coupled transformer of claim 11, wherein each of said first and second secondary circuits comprises a coil, and each of said spacers comprises a ceramic spacer within said coil.

13. The air-coupled transformer of claim 12, wherein each of said ferromagnetic pieces comprises a rectangular plate rigidly fastened to said ceramic spacer.

14. The air-coupled transformer of claim 13, wherein said primary circuit comprises a current conductor interposed between said ferromagnetic pieces and said coils so as to be perpendicular to a window formed by said ferromagnetic pieces and the coils.

15. An unshielded air-coupled transformer for transforming an input current flowing in an input line into an output signal comprising:

(a) a primary circuit coupled to said input line for supplying the input current;

(b) a first secondary circuit adjacent said primary circuit;

(c) a second secondary circuit adjacent said primary circuit;

(d) said first and said second secondary circuits being coupled so as to form the output signal in response to the input current and to reduce a disturbing magnetic flux from an external source;

(e) a magnetic circuit magnetically coupling said primary circuit and said first and said second secondary circuits to further reduce the disturbing magnetic flux; and (f) said magnetic circuit comprising a pair of plates, said plates being substantially flat, substantially rectangular, and substantially parallel, said plates having at least a pair of air gaps therebetween, and including at least a pair of ceramic spacers inserted into said air gaps to make the scale factor of said transformer independent of temperature, said primary circuit and said first and said second secondary circuits being between said pair of plates with said first and said second secondary circuits surrounding no magnetic core material.

* * * * *